US006170146B1

(12) United States Patent
Katagiri et al.

(10) Patent No.: US 6,170,146 B1
(45) Date of Patent: Jan. 9, 2001

(54) ROTOR ASSEMBLING METHOD

(75) Inventors: Masayuki Katagiri; Hiromitsu Takei; Hiromi Miyazawa, all of Nagano (JP)

(73) Assignee: Kabushiki Kaisha Sankyo Seiki Seisakusho, Nagano (JP)

( * ) Notice: Under 35 U.S.C. 154(b), the term of this patent shall be extended for 0 days.

(21) Appl. No.: 09/132,776

(22) Filed: Aug. 12, 1998

(30) Foreign Application Priority Data

Aug. 12, 1997 (JP) ..... 9-230280

(51) Int. Cl.[7] ..... H01R 43/06

(52) U.S. Cl. ..... 29/597; 29/733; 29/732; 29/598; 310/234

(58) Field of Search ..... 29/597, 596, 598, 29/729, 733, 732, 736, 705; 310/10, 234, 43, 237; 219/78.07

(56) References Cited

U.S. PATENT DOCUMENTS 4,577,399 * 3/1986 Ott ..... 29/733
4,945,631 * 8/1990 Banner et al. ..... 29/705
5,325,575 * 7/1994 Ichikawa ..... 29/281.5
5,658,477 * 8/1997 Kerker et al. ..... 219/125.1

FOREIGN PATENT DOCUMENTS 60-102847 * 6/1985 (JP) ..... 29/733

* cited by examiner

*Primary Examiner*—Lee Young
*Assistant Examiner*—Minh Trinh
(74) *Attorney, Agent, or Firm*—Sughrue, Mion, Zinn, Macpeak & Seas, PLLC

(57) ABSTRACT

Through-holes 14 are formed in an armature core 11, and engaging portions 21 are formed in an commutator unit 15 at positions corresponding to the through-holes 14. Positioning pins 23 are inserted into the through-holes 14 and the engaging portion 21 to exactly position the armature core 11 to the commutator unit 15. The coil terminals are soldered to risers 18 in a state that the under side of the risers 18 are supported by the tips 35 of legs 36 standing erect on a support tool 34, inserted through the open slots 33.

5 Claims, 5 Drawing Sheets

ROTOR ASSEMBLING METHOD

BACKGROUND OF THE INVENTION

1. Field of the Invention

The present invention relates to a rotor used for a small motor, and more particularly to a method for assembling a rotor in a DC motor with a brush, which has a 4-6 (four magnet poles and six salient poles of the armature core) structure.

2. Related Art

Referring to FIG. 8, there is illustrated a rotor 100 of a small motor with a brush which has a 2-3 (2 magnetic poles -3 salient poles) structure. In the rotor 100, an commutator unit 120 is provided with a armature core 101 and three commutator pieces 103 separated by slits 104. The armature core 101 has three salient poles 102 radially extended therefrom. Coils (not shown) of different phases are wound around the salient poles 102. The commutator unit 120 is tightly coupled to a shaft 107. In this type of the motor, an exactness of the timing of switching the current feeding to the coils of the phases depends largely on an accuracy of the alignment of the center line P1 of each salient pole 102 with the center line of the corresponding slit 104. Therefore, a misalignment of those center lines degrades the switching timing exactness, and causes cogging and an increase of torque ripple.

In a conventional measure taken for securing an exact alignment of the center lines, positioning protrusions 106 formed on an commutator holder 105 are fit into recesses 109 formed near a shaft hole 108 of the armature core 101.

In the DC motor of the 2-3 structure, the conventional measure secure secures an alignment accuracy to some degree. However, the following problem is inevitably created. The recesses 109 are excessively close to the center of the shaft hole 108. As seen from FIG. 9 showing the positioning protrusions 106 of the commutator holder 105 and the recesses 109 of the shaft hole 108, minute dimensional errors arising from dimensional inaccuracy of each part and of the part-to-part are enlarged in the radial direction. Therefore, it is impossible to expect the alignment accuracy as designed, in practical use.

In the DC motor of the 4-6 structure or higher grade structure (the number of salient poles is larger), the slits 104 and the commutator pieces 103 are increased in number. Therefore, an angle of each curved commutator piece 103 is halved, and as a result, the contact area of each commutator piece 103 with the commutator holder 105 is reduced. As a result, the commutator pieces 103 is easily tiltable, and more strict requirements are put on the assembling accuracy of the commutator unit 120 and position accuracy of the salient poles 102 of the armature core 101 to the commutator unit 120. In the DC motor of the 2-3 structure, a tolerable alignment (deviation angle) of the center line P1 of the salient pole 102 to the center line P2 of the slit 104 is 3° or smaller. In the DC motor of the 4-6 structure, it is 1.5° or smaller. Therefore, some adjustment is essential in manufacturing stage.

The terminals of the coils 110 wound on the salient poles 102 of the armature core 101 are connected to the armature risers 111, and soldering is applied thereto by a soldering iron. In the soldering process, pressing force and heat by and from the soldering iron possibly deform (denoted as H) of the risers 111 and the commutator holder 105, and degrade the roundness of the commutator pieces 103. When the DC motor of the 2-3 structure is compared with the DC motor of the 4-6 structure, a larger number of solderings must be applied to the risers 111 in the latter motor, and much heat stays there since the soldering points are more densely located. The thermal deformation H is more intensive.

SUMMARY OF THE INVENTION

Accordingly, an object of the present invention is to provide a rotor assembling method which can exactly position the salient poles of the armature core to the commutator unit and lessen the adverse effects by the soldering process to a minimum.

According to an aspect of the present invention, there is provided a rotor assembling method comprising the steps of:

forming a shaft hole at the center of an armature core with salient poles on which coils are wound and forming through-holes at positions apart from said shaft hole;

forming engaging portions in an commutator unit at positions corresponding to said through-holes of said armature core;

inserting a rotary shaft into and through said shaft hole of said armature core and fixing said rotary shaft therein; and inserting positioning pins into said through-holes of said armature core from one side of said through-holes, and bringing said engaging portions into engagement with said positioning pins protruded above the other side of said through-holes so that said armature core is positioned relative to said commutator unit, and fixing said commutator unit into said shaft.

In the rotor assembling method of the invention, the through-holes of the armature core are aligned with the engaging portions by use of the positioning pins. The positioning of the armature core to the commutator unit is carried out in easy and quick manner. This leads to improvement of the motor characteristic.

In soldering for the connection of the coil terminals to the risers, the commutator holder and the risers are supported, from their underside, by the support tool. Therefore, the soldering may be carried out without the adverse effect of the heat and force by the soldering iron, viz., free from thermal deformation of the support tool and the risers, and crack of the quenching element by heat. The result is to provide efficient manufacturing and assembling.

DETAILED DESCRIPTION OF THE PREFERRED EMBODIMENTS

Figure 1:
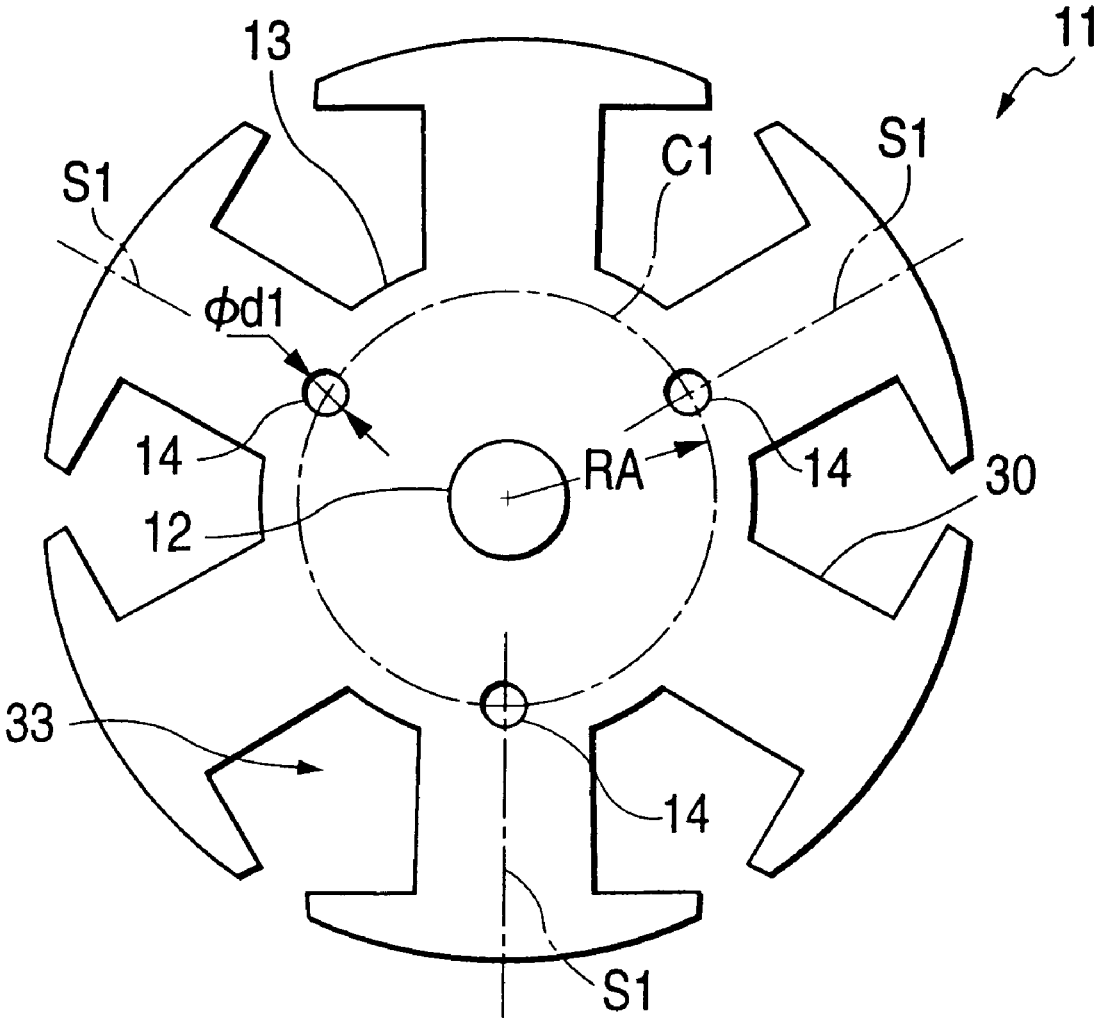
FIG. 1 is a plan view showing an armature core used in a rotor manufacturing method of the invention.

The preferred embodiment of a rotor assembling method according to the present invention will be described with reference to the accompanying drawings. FIG. 1 is a plan view showing an armature core 11 in a 4-6 structure DC motor with a brush. As shown, six salient poles 30 are radially extended from a base portion 13. A hole 12 is bored at the central part of the base portion 13.

Through-holes 14, which are formed in the base portion 13, are located at three positions equidistantly arranged on the circumference C1 of the radius RA which is coaxial with the shaft hole 12.

Figure 2:
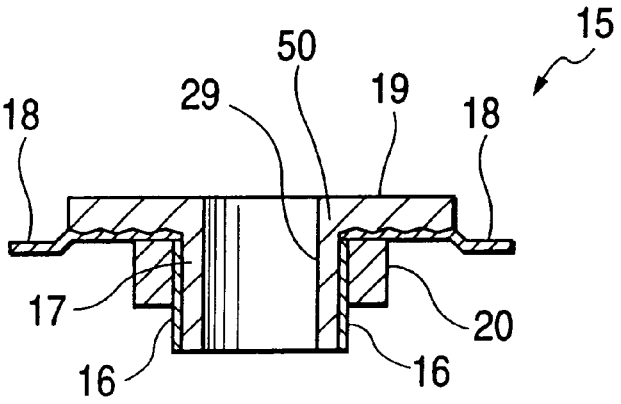
FIG. 2 is a cross sectional view showing the armature core of FIG. 1.
Figure 3:
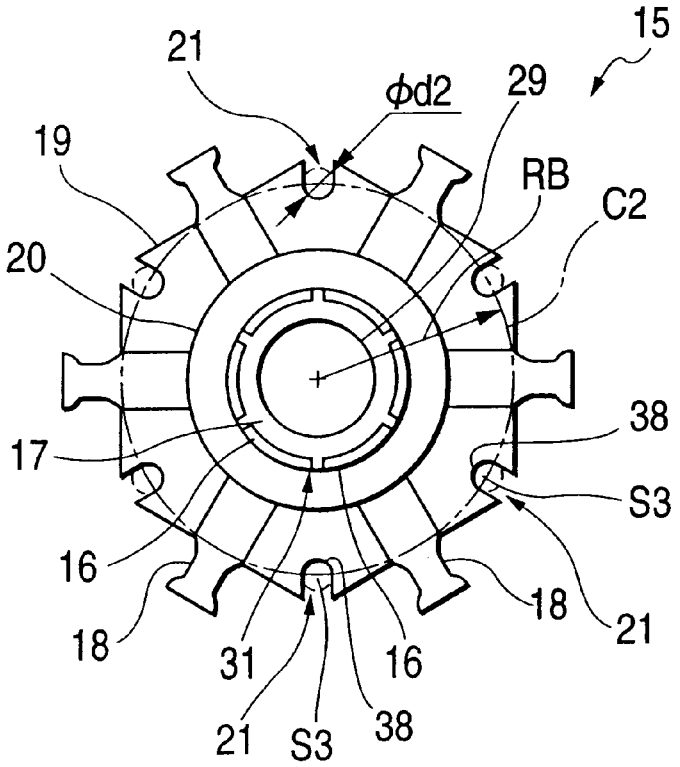
FIG. 3 is a plan view showing the armature core of FIG. 1.

FIGS. 2 and 3 cooperate to show commutator unit 15. FIG. 2 is a cross sectional view showing the commutator unit 15, and FIG. 3 is a plan view of the same. The commutator unit 15 is made up of an commutator holder 50, six commutator pieces 16 fit to the outer circumferential surface of the commutator holder 50, and a hold ring 20 which is put on those commutator pieces 16 to fasten them onto the outer surface of the commutator holder 50. The commutator holder 50 is formed with a cylindrical portion 17 for supporting the commutator pieces 16 and a flange portion 19 provided at one end of the cylindrical portion 17. The commutator holder 50 thus configured is made of synthetic resin and formed by molding. Risers 18 are radially extended from the ends of the commutator pieces 16 and supported on the flange portion 19.

In FIG. 3, six commutator pieces 16 are equidistantly disposed on the outer circumferential surface of the cylindrical portion 17. The risers 18 are radially extended from the commutator pieces 16. The flange portion 19 includes engaging portions 21 each located at a mid position between the adjacent risers 18.

Figure 5:
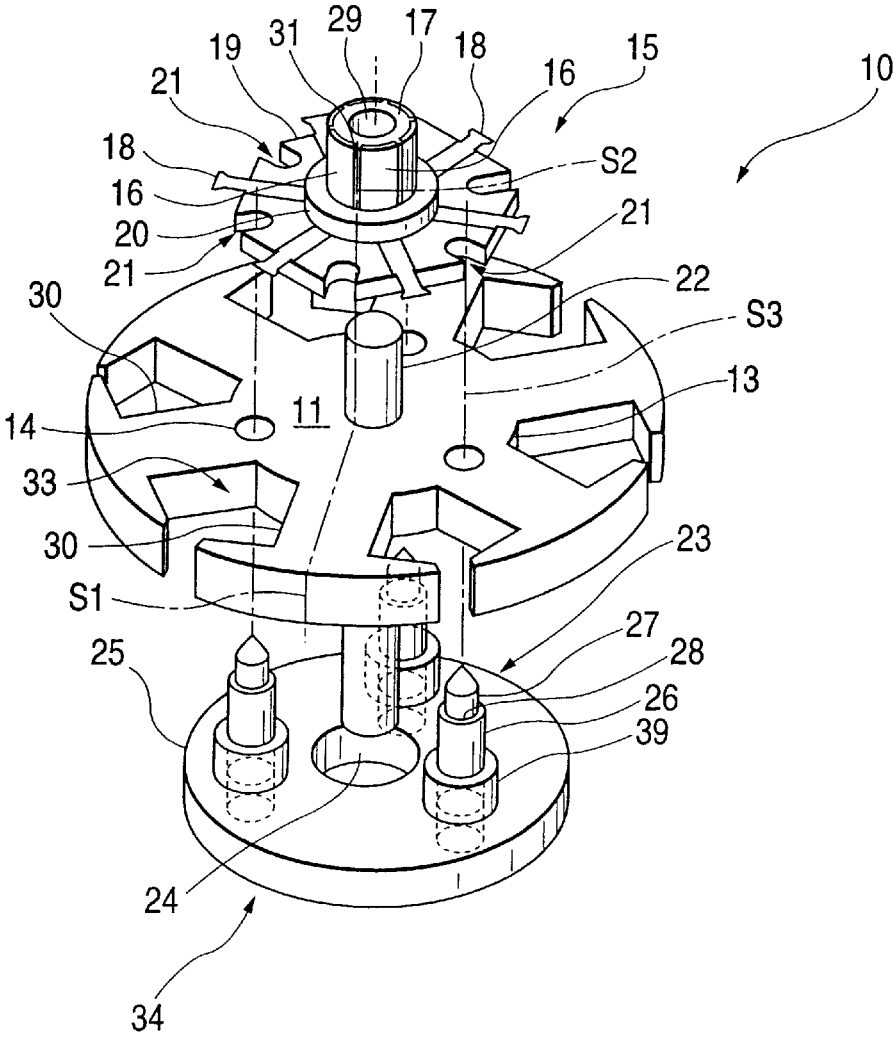
FIG. 5 is an exploded, perspective view useful in explaining the rotor assembling method.

FIG. 5 is a perspective view useful in explaining the assembling of a rotor 10 into the DC motor. A shaft hole 12 of the armature core 11 is fit to the shaft 22 and fastened to a predetermined position. Positioning pins 23 are planted in a base member 25 having a central hole 24 whose diameter is sufficiently larger than that of the shaft 22. Each of the positioning pins 23 is formed with a pin 26 to be fit into the corresponding through-hole 14 whose diameter is ϕd1, and a positioning part 27 of ϕd2 in diameter to be fit into the corresponding engaging portion 21 of the commutator holder 50 to secure a correct alignment.

The diameter ϕd1 of the pin 26 is larger than the diameter ϕd2 of the positioning part 27, and the joint of the pin 26 and the positioning part 27 takes the form of a flat stepped part 28. The positioning part 27 is tapered to the end thereof so as to easily be guided into the corresponding engaging portion 21.

The positioning pins 23 are applied to the lower side of the armature core 11 and inserted into the through-holes 14 so as to position the flat stepped parts 28 of the positioning pins 23 above the upper surface of the armature core 11. Then, the commutator holder 50 is applied to the upper side of the armature core 11 and a shaft hole 29 of the commutator holder 50 is forcibly applied to the shaft 22, whereby the engaging portions 21 are brought into engagement with the positioning parts 27 of the positioning pins 23, respectively. The lower side of the commutator holder 50 is brought into contact with the flat stepped parts 28 and the holder is manually adjusted by force till it is steadily placed. Consequently, armature slits 31 are highly precisely positioned to the salient poles 30 of the armature core 11.

As shown in FIGS. 1 and 5 and already referred to, three through-holes 14 are provided in connection with three positioning pins 23. The combination of one through-hole 14 and one positioning pin 23 will suffice for securing the relative positioning of the armature core 11 to the commutator unit 15 so long as the armature core 11 and the commutator unit 15 are properly positioned.

Figure 6:
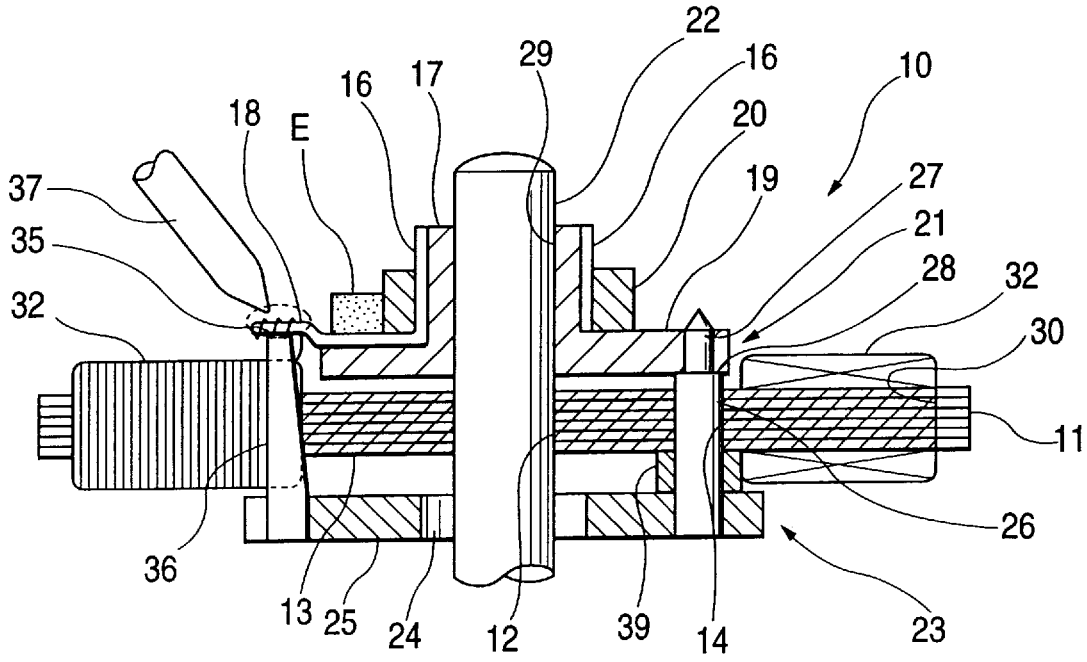
FIG. 6 is a cross sectional view useful in understanding soldering work.
Figure 7:
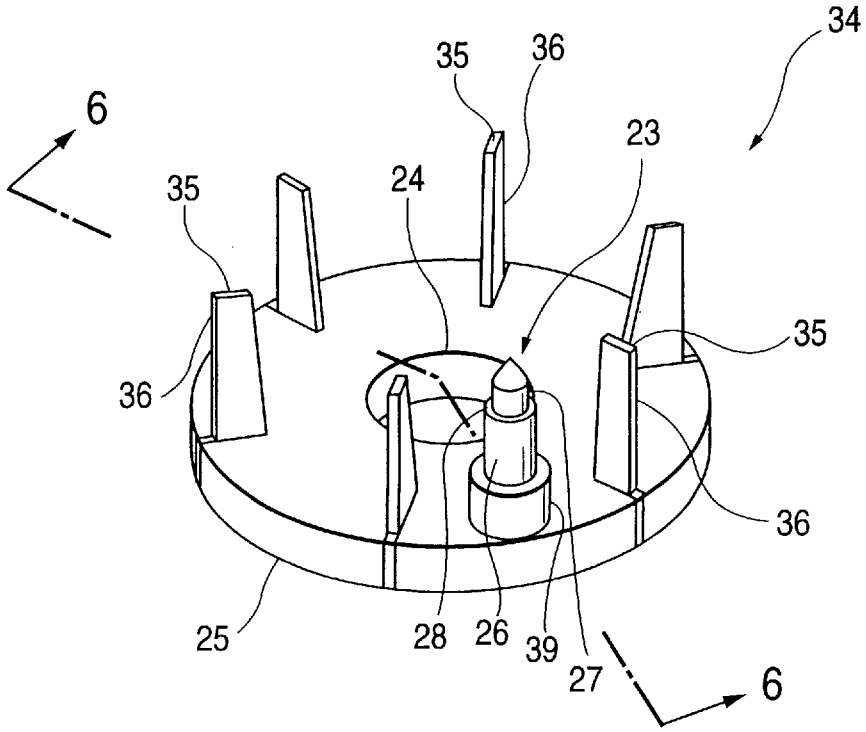
FIG. 7 is a perspective view showing a support tool used in the rotor assembling work.
Figure 8:
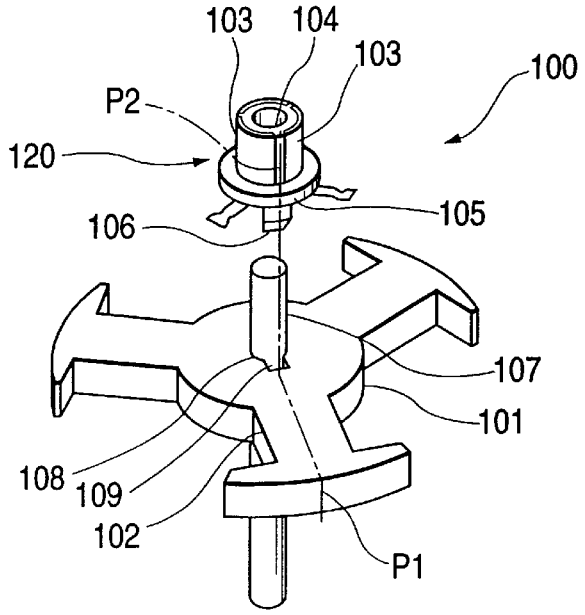
FIG. 8 is an exploded perspective view of a rotor of a 2-3 structure DC motor with a brush.
Figure 9:
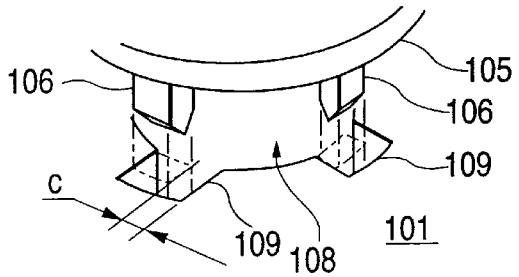
FIG. 9 is an enlarged, perspective view useful in explaining the problem of a conventional rotor assembling method.
Figure 10:
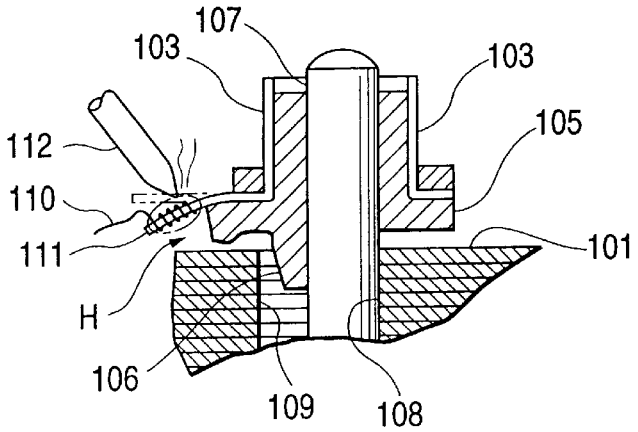
FIG. 10 is a cross sectional view useful in explaining the problem in the soldering work when the conventional rotor assembling method is executed.

FIG. 6 is a cross sectional view, taken along line 6—6 in FIG. 7, showing an example of a support tool 34 used for the soldering of the joint of the riser 18 and the terminal of coils 32 and the soldering to a quenching element E. In use, the legs 36 of the support tool 34 are respectively inserted into open slots 33 of the armature core 11 till the tips 35 of the legs 36 hit the lower surfaces of the risers 18. Since the support tool 34 supports the risers 18 with its legs, the commutator holder 50 and the risers 18 are protected against the mechanical and thermal deformation by force and heat by and from the soldering iron.

A rotor assembling method which is an embodiment of the present invention will be described with reference to FIGS. 1 through 5. The center of each of the through-holes 14, which are located at three positions equidistantly arrayed on the circumference C1 of the radius RA, lies on the center line S1 of the salient pole 30.

The engaging portions 21 of the flange portion 19 of the commutator holder 50 (FIG. 3) are each shaped like U in cross section.

The bottom 38 of the U-shaped engaging portion 21 is arcuate so as to receive the positioning part 27 (whose diameter is ϕd2) of each positioning pin 23 in a well-fitting fashion. A reference axial line S3 of each engaging portion 21 lies at the center of the arc of the bottom 38 of the U-shaped engaging portion 19. Those axial lines S3 are located at six positions equidistantly on the circumference C2 defined by the radius RB which is coaxial with the shaft hole 29 of the commutator holder 50.

The engaging portions 21 are each shaped like U in cross section as shown in FIG. 3, and the bottom of the shape U is arcuate.

Figure 4A:
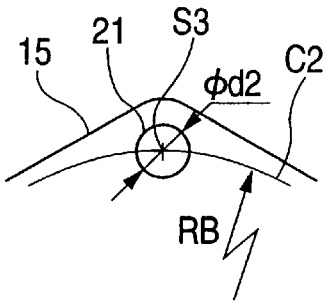
FIG. 4(*a*), FIG. 4(*b*) and FIG. (*c*) is a plan view showing, in enlarged fashion, some variations of engaging portions of the armature core of FIG. 1.
Figure 4B:
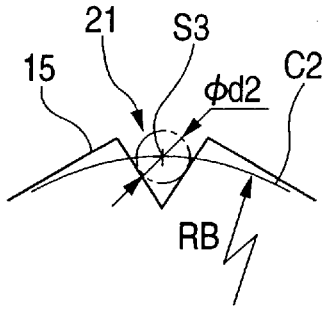
Figure 4C:
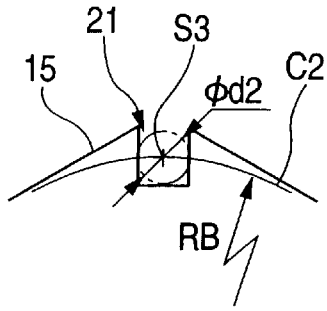

However, the engaging portion 21 may take any other suitable shape if it can block the movement in the circumferential direction. The engaging portion may be varied in shape as shown in FIGS. 4(*a*) to 4(*c*). FIG. 4(*a*) shows a circular engaging portion, which is coaxial with the through-hole 14 associated therewith and to be fit to the pin of ϕd2 in diameter. FIG. 1(*b*) shows an engaging portion shaped like V in cross section. A circle of ϕd2 in diameter which is coaxial with the through-hole 14 is inscribed within the V-shaped engaging portion. FIG. 1(*c*) shows an engaging portion rectangular in cross section which is sized so as to receive the pin of ϕd2 in diameter when the pin is inserted thereinto. For those engaging portions 21 shown in FIGS. 4(*a*) to 4(*c*), each of their reference axial lines S3 includes the center of the pin of the diameter d2 whose circumference is inscribed within the engaging portions 21.

The reference axial line S3 of each engaging portion 21 is radially aligned with the mid position S2 (FIG. 5) of each slit 31 on the center line between the adjacent risers 18. The radius RB of the circumference C2 including the reference axial lines S3 of the engaging portion 21 is exactly equal to the radius RA of the circumference C1 including the centers of the through-holes 14 of the armature core 11. Therefore, the arcuate bottoms 38 of the U-shaped engaging portions 19 are exactly aligned with the through-holes 14 in one-to-one correspondence.

In combining the armature core 11 with the commutator unit 15, the core and unit alignment may be performed in quick and easy manner since there is no need of searching for a specific position for the combination. As already stated, the positioning pins 23 are inserted into the through-holes 14, and the centers of the through-holes 14 are made coincident with the centers of the engaging portions 21. Then, the mid positions S2 of the armature slits 31 are exactly put on the center lines S1 of the salient poles 30. Therefore, the armature core 11 and the commutator unit 15 are mechanically and electrically positioned, thereby securing an exact positioning of the armature core 11 relative to the commutator unit 15.

In FIG. 7 showing the support tool 34, one positioning pin 23 stands erect on the base member 25. The legs 36 are planted at six positions corresponding to the risers 18 in a state that their width are radially directed. Alternatively, the positioning pins 23 equal in number to the through-holes 14 may be used while being located corresponding to the through-holes 14. By so doing, the commutator holder 50 is stable against a pressing force by the soldering iron. Most of each open slot 33 is occupied by the coils 32 wound on the salient poles 30 located on both sides of the open slot. Therefore, the legs 36 supporting the risers 18 are preferably formed with thin plate made of FRP, for example, so as to be inserted into the gaps each present between the coils 32. The assembling of the rotor follows. The shaft 22 is inserted into the shaft hole 12 of the armature core 11 (FIG. 6). The surface of the armature core 11 is coated for insulation or the coils 32 are processed for insulation by an insulator (not shown). Thereafter, the shaft hole 29 of the commutator holder 50 is applied to the shaft 22.

The pins 26 of the positioning pins 23 are inserted into the through-holes 14 from the under sides of those holes, and the commutator holder 50 is moved down along the shaft 22 till the lower sides of the engaging portions 21 come in contact with the flat stepped part 28 of the positioning part 27. Reference numeral 39 designates a collar to determine the height of the flat stepped part 28 protruded above the upper side of the armature core 11. The collar may be replaced with another collar of suitable size, if required.

After the forcible insertion of the commutator holder 50, the terminals of the coils 32 put on the salient poles 30 are connected to the risers 18, and in this state the soldering is applied thereto by manual or automatically by a soldering machine. Also at this time, the positioning pins 23 are left inserted into the through-holes 14 and the engaging portion 21, and the flange portion 19 of the commutator holder 50 and the risers 18 are supported, from their underside, with the tips 35 of the legs 36. The risers 18 sufficiently resist the force by the tip of the soldering iron, and heat by the soldering iron is led to the legs 36. Therefore, the roundness of the commutator pieces 16 is little degraded, securing a good precision.

As seen from the foregoing description, in the rotor assembling method of the invention, the through-holes of the armature core are aligned with the engaging portions by use of the positioning pins. The positioning of the armature core to the commutator unit is carried out in easy and quick manner. This leads to improvement of the motor characteristic.

In soldering for the connection of the coil terminals to the risers, the commutator holder and the risers are supported, from their underside, by the support tool. Therefore, the soldering may be carried out without the adverse effect of the heat and force by the soldering iron, viz., free from thermal deformation of the support tool and the risers, and crack of the quenching element by heat. The result is to provide efficient manufacturing and assembling.

What is claimed is:

1. A rotor assembling method comprising the steps of:

forming a first shaft hole at the center of an armature core with salient poles on which coils are wound;

forming through-holes in said armature coil equidistantly arranged along a circumference which is coaxial with said first shaft hole; forming a second shaft hole at the center of a commutator unit, said commutator unit comprising a plurality of equally segmented commutator pieces erect in an axial direction and arranged along a circumference which is coaxial with said second shaft hole, risers electrically continuous with said commutator pieces, and a commutator holder for holding said commutator pieces and said risers;

forming engaging portions in said commutator unit at positions corresponding to said through-holes of said armature core;

inserting a rotary shaft into and through said first shaft hole of said armature core and fixing said rotary shaft therein;

mounting the armature core on a supporting jig having at least one positioning pin having a guide portion at a free end; and assembling said armature core and said commutator unit to form a rotor assembly by inserting the positioning pin into one of said through-holes of said armature core from one side of said one of said through-holes, and bringing at least one of said engaging portions into engagement with the positioning pin protruded above the other side of said one of said through-holes so that said armature core is positioned relative to said commutator unit, fixing said commutator unit onto said shaft, and connecting said users to said coils; and removing said support jig from said rotor assembly.

2. The rotor assembling method according to claim 1, wherein said engaging portions are each formed in said commutator holder at a mid position between said adjacent risers.

3. The rotor assembling method according to claim 1, wherein said supporting jig further comprises plural legs standing erect in the axial direction, said legs having distal tips, the method further comprising the step of:

soldering said coils to said risers in each open slot located between adjacent ones of the salient poles of said armature core by use of said supporting jig such that said tips of said legs are brought into contact with said commutator holder located near said risers.

4. The rotor assembling method according to claim 1, wherein said supporting jig further comprises plural legs standing erect in the axial direction, said legs having distal tips, the method further comprising the step of:

soldering said coils to said risers in each open slot located between adjacent ones of the salient poles of said armature core by use of said supporting jig such that said tips of said legs are brought into contact with said risers.

5. The rotor assembling method according to claim 1, wherein said armature core includes six salient poles and a drive magnet having four magnetic poles disposed facing said salient poles.

* * * * *